US005538615A

United States Patent [19]

Palumbo et al.

[11] Patent Number: 5,538,615

[45] Date of Patent: Jul. 23, 1996

[54] METAL TUBE HAVING A SECTION WITH AN INTERNAL ELECTROFORMED STRUCTURAL LAYER

[75] Inventors: Gino Palumbo, Etobicoke; Philip C. Lichtenberger, Burlington; Francisco Gonzalez, Toronto; Alexander M. Brennenstuhl, Compbellville, all of Canada

[73] Assignee: Ontario Hydro, Toronto, Canada

[21] Appl. No.: 369,969

[22] Filed: Jan. 9, 1995

Related U.S. Application Data

[63] Continuation-in-part of Ser. No. 152,714, Nov. 16, 1993.

[51] Int. Cl.[6] ..... C25D 7/04

[52] U.S. Cl. ..... 205/50; 205/73; 205/115; 205/131; 205/151

[58] Field of Search ..... 205/50, 73, 131, 205/151, 115

[56] References Cited

U.S. PATENT DOCUMENTS

| | | | |
|---|---|---|---|
| 2,106,004 | 1/1938 | Inglee | 204/300 R |
| 2,764,540 | 9/1956 | Farin et al. | 204/129.7 |
| 3,103,235 | 9/1963 | Stringham | 138/97 |
| 3,125,464 | 3/1964 | Harmes | 118/105 |
| 3,287,248 | 11/1966 | Braithwaite | 204/260 |
| 3,618,639 | 11/1971 | Daley et al. | 138/97 |
| 3,673,073 | 6/1972 | Tobey et al. | 204/226 |
| 4,080,268 | 3/1978 | Suzuki et al. | 205/131 |
| 4,120,994 | 10/1978 | Inoue | 427/239 |
| 4,200,674 | 4/1980 | Inoue | 427/290 |
| 4,227,986 | 10/1980 | Loqvist et al. | 204/209 |
| 4,280,882 | 7/1981 | Hovey | 205/50 |
| 4,416,737 | 11/1983 | Austin | 205/99 |
| 4,624,750 | 11/1986 | Malagola | 205/131 |
| 4,687,562 | 8/1987 | Smith et al. | 204/206 |
| 4,696,723 | 9/1987 | Bosquet et al. | 205/115 |
| 4,780,072 | 10/1988 | Burnette | 425/62 |
| 4,826,582 | 5/1989 | Lavalerie | 204/196 |
| 4,849,084 | 7/1989 | Vouzellaud | 204/224 R |
| 4,853,099 | 8/1989 | Smith | 204/224 R |
| 4,931,150 | 6/1990 | Smith | 205/118 |
| 5,352,266 | 10/1994 | Erb | 75/300 |

FOREIGN PATENT DOCUMENTS 1572867 3/1977 United Kingdom .

OTHER PUBLICATIONS

Grain Boundary Design and Control for Intergranular Stress–Corrosion Resistance, G. Palumbo et al., Scripta Metallurgica et Materialia, vol. 25, pp. 1775–1780, 1991.

Deviations From Hall–Petch Behaviour in As–Prepared Nanocrystalline Nickel, A. M. El–Sherik et al., Scripta Metallurgia et Materialia, vol. 27, pp. 1185–1188, 1992.

Chemical Abstracts, vol. 103, No. 16, 21 Oct. 1985, Columbus Ohio, U.S.; Abstract No. 131280j, Vasilefa 'nickel electro–plating of zinc alloy articles; bath & method' p. 519.

DiBari, George, "Nickel Plating", Metal Finishing Handbook (Jan. 1987).

Suryanarayana, C., "Structure and Properties of Nanocrystalline Materials", Bulleting of Materials Science, V. 17, No. 4, pp. 307–46 (Abstract only).

*Primary Examiner*—John Niebling
*Assistant Examiner*—Brendan Mee
*Attorney, Agent, or Firm*—Ridout & Maybee

[57] ABSTRACT

The invention is a metal tube such as a heat exchanger tube which has been treated by in situ electrodeposition to repair one or more degraded sections. The repaired metal tube section has an electroformed structural layer which has an ultrafine grain microstructure of sufficient thickness to restore the degraded section at least to its original mechanical specifications.

13 Claims, 9 Drawing Sheets

METAL TUBE HAVING A SECTION WITH AN INTERNAL ELECTROFORMED STRUCTURAL LAYER

This application is a continuation-in-part of U.S. Ser. No. 08/152,714 filed Nov. 16, 1993, which is pending.

The invention is a process and apparatus for structurally reinforcing a tube by in situ electroforming. The process is particularly useful for repairing heat exchanger tubes which have been degraded by such things as localized and general corrosion, stress or fatigue cracking. The process has particular application for the maintenance and repair of high temperature and pressure heat exchangers used in power generating facilities such as nuclear power plants.

While the skilled person will appreciate that the invention has general industrial utility and application for a variety of metal vessel repair situations, the process will be described with particular reference to heat exchanger tubing. In this regard, the maintenance of the structural integrity of heat exchanger tubes presents an ongoing industrial problem. Heat exchanger tube walls must be strong and corrosion resistant while also being as thin as possible to provide efficient heat transfer across the tube wall. Under certain environmental conditions, heat exchanger tubes deteriorate, but the deterioration may not occur uniformly. Rather, micro-cracks or other imperfections provide sites for localized tube degradation, which if repaired, can significantly extend the life of the entire tube.

When repairing a section of degraded tubing, it is essential to restore the wall to its initial mechanical design specifications, e.g., burst pressure (hoop strength), bend strength, fatigue endurance and corrosion allowance. Currently, the common practice for tube repair involves inserting a tubular sleeve of appropriate dimensions and mechanical characteristics into the tube section requiring repair, and fixing the sleeve in place at its extremities by friction bonding, welding or brazing to the tube.

This sleeving technique suffers from several disadvantages. The degraded tube section requiring repair may not be a suitable candidate for sleeving due to its location or geometry. Sleeved tube sections do not perform to original heat transfer specifications due to the double wall effect and the reduced flow cross section of the sleeved tube portion. For example, the area of attachment of the sleeve to the tube is relatively small and a crevice exists between the sleeve and the tube which reduces heat transfer. The introduction of a severe metallurgical discontinuity at the bonding site may result in a degradation in the mechanical properties and corrosion resistance of the tube at that location.

While in situ electrodeposition of thin anti-corrosion layers of metal has been known for some time, e.g., U.S. Pat. No. 4,624,750, the present invention provides an improved process which enables the electroforming of a structural layer of metal bonded to the internal wall of a degraded section of a metal tube. The electroforming conditions result in a metal layer possessing an ultrafine grain microstructure which may also possess a high degree of crystal lattice twinning between metal grains (i.e., "special" grain boundaries), thereby imparting a high degree of strength and corrosion resistance to the deposited layer while maintaining excellent ductility.

Accordingly, the invention provides a method for in situ electroforming a structural layer of metal bonded to an internal wall of a degraded section of a metal tube, comprising the steps of:

a) mechanically cleaning the internal tube wall surface in the tube section;

b) inserting a probe into the metal tube and moving it so that it spans the degraded tube section, the probe having an electrode extending substantially along its length, sealing means at one or both ends for containment of fluids within the tube section, and circulation means for flowing fluids into and out of the tube section; and c) electroforming a structural layer of metal on the tube wall by flowing an electrolyte containing at least one metal salt of interest through the section and applying a pulsed direct current between the electrode and the metal tube at a frequency of 10 to 1000 Hz with a duty cycle in the range 10 to 60% to electroform a metal layer 0.1 to 2 mm thick.

The invention also includes a probe for carrying out the process of the invention. The probe of the invention is insertable into a metal tube to be repaired. Preferably, the metal tube has an internal diameter of at least 5 mm. The probe comprises sealing means located at one or both ends of the probe for securing the probe in a section of the tube, thereby defining a cell, and for containing the flow of fluids within the tube section. An electrode, such as a flexible tubular structure formed from platinum wire, extends substantially the length of the probe. A porous non-conductive, preferably plastic, tubular housing preferably surrounds the electrode along its entire length. The probe has fluid circulating means which provide flow communication between the cell and an external fluid reservoir.

The invention will be described in relation to the in situ repair of metal tubes such as heat exchanger tubes made of any of the commercial iron, copper and nickel based alloys. The electroformed metal layer deposited according to the invention may comprise any commercial iron, nickel, chromium or copper bearing alloy. The internal diameter of the tube being repaired is at least 5 mm, but typically is in the range 10 mm to 50 mm; and the length of tube section being repaired may be as short as 5 mm, but typically is in the range 100 mm to 900 mm. The following description illustrates the method of the invention as it relates to the deposition of nickel on the internal wall of a tube. The artisan will appreciate that the invention has a more general application than that specifically described herein.

Figure 1:
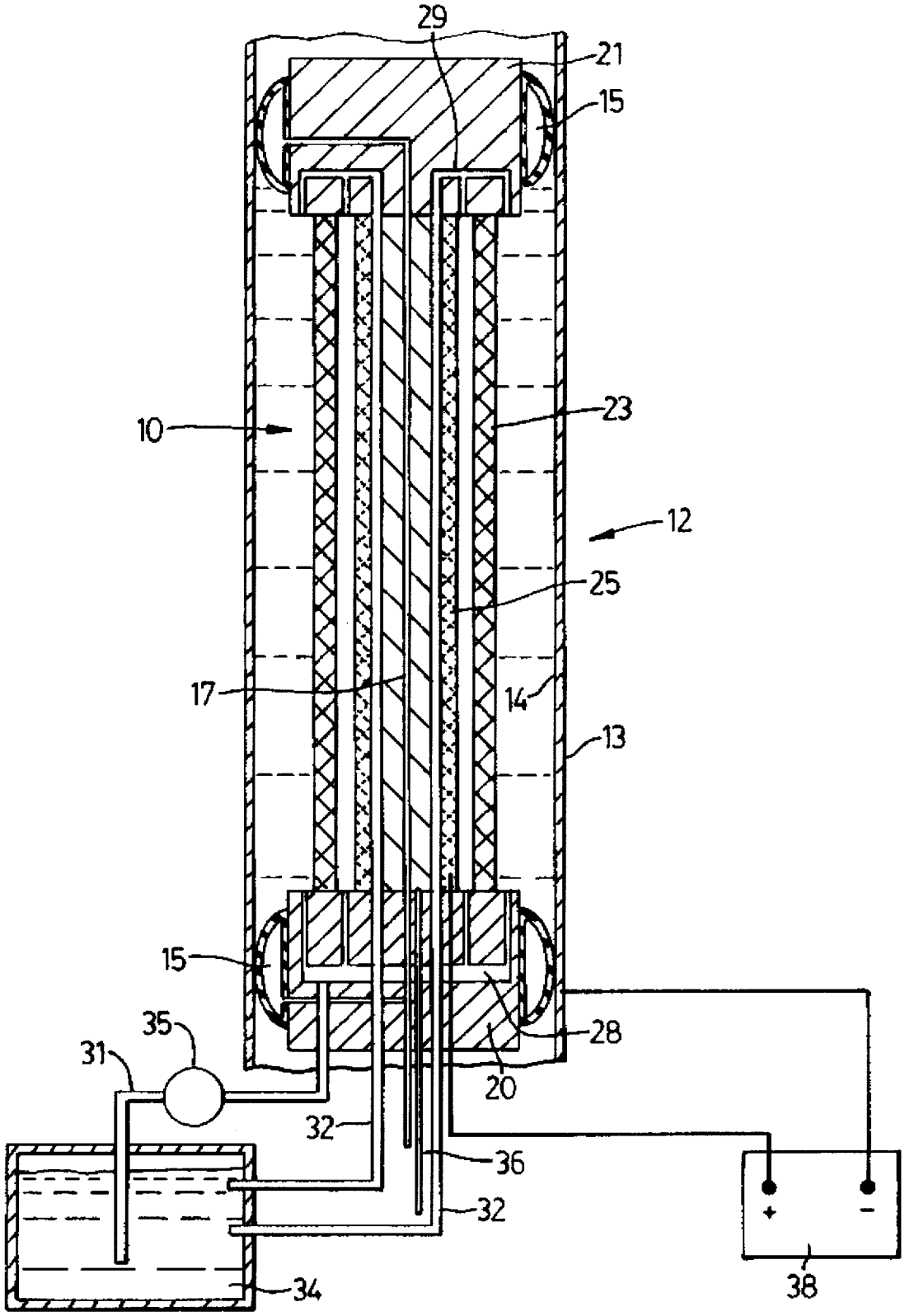
FIG. 1 is a cross sectional view of a probe for insertion into a tube having sealing means at each end, fluid circulation means and an electrode.

Referring to FIG. 1, a probe 10 is inserted into a metal tube 12, such as a nickel/copper alloy heat exchanger tube, and manipulated to a section 13 of the tube 12 requiring repair. The tube section 13 has an inner wall 14. The probe 10 has seals 15, which are preferably inflatable, at each end to isolate the probe 10 within the tube section 13 and to contain electrolyte and other process fluids within the section 13. The seals 15 are inflated through a capillary air line 17 connected to a pressurized air supply preferably in the range 10–40 psig. The seals 15 are provided about end base 20 and head 21 pieces which preferably are cylindrical in shape. An outer tubular porous plastic housing 23, which may be a plastic weave such as polypropylene, extends between the base 20 and head 21, and contains an electrode 25, which is the anode under electrodeposition conditions at the tube wall 14 and which preferably is a flexible porous tubular member made of woven Pt wire extending between the base 20 and head 21 of the probe 10. The flexible housing 23 provides an interface between the anode and cathode, i.e., the electrode 25 and tube 13; thus, preventing shorting during electrodeposition. The housing also hinders interference with the metal deposition at the tube wall 14 which may be caused by gases or sludge particles generated during electroforming. Fluids are circulated through the tube section 13 via a feed inlet means 28 and an outlet means 29 formed in the base 20 and head 21 respectively. Conduits 31 and 32 connect the inlet and outlet means 28 and 29 with a reservoir 34 and associated pump means 35. Preferably, a thermocouple 36 is provided through the base 20 to monitor the temperature during electroforming. The anode 25 and tube section 13 (cathode) are connected to a direct current power supply 38 by means of suitable conductor leads.

The air line 17, conduits 32, tubular anode 25, and tubular plastic housing 23 are all flexible to allow the probe 10 to be snaked through a tube 12 having curves or bends in it. Once the probe 10 is positioned at the desired location in the tube 12, pressurized air is provided through the line 17 thereby inflating the seals 15. Preferably, the seals 15 are toroidal rubber members which may be ribbed to provide a stronger grip against the inner tube wall 14. The skilled person will appreciate that other sealing means, such as thermally expandable O-rings, may be used to affect the same purpose as the inflatable seals 15 of this embodiment. Also, different types of seals may be used at each end of the probe 10. In some applications, it may be useful to have an inflatable seal 15 at the base 20 with the seal at the other end of the probe 10 being effected by a separate removable plug (not shown).

Fluids may be delivered to and circulated through the seated probe 10 via the inlet and outlet means 28 and 29 with their associated conduits 31 and 32. The conduits 31 and 32 may be quite long (e.g., up to 500 ft.) depending on the application. While only one fluid reservoir 34 is shown in FIG. 1, clearly, a plurality of fluid reservoirs can be used with appropriate valving to supply and circulate the process fluids to and through the probe 10. The skilled person will understand that a preferred fluid delivery system for the probe 10 will include pumps, valves and programmable controlling and monitoring devices to provide fluid flows through the probe 10 under precise flow rate, pressure and temperatures conditions.

Preferably, the power supply 38 is a commercial pulse plating direct current unit having a 400A/20 V peak output. Clearly, a busbar (not shown) may be used to connect a plurality of probes 10 which are inserted into a plurality of tubes 12.

In some cases, it will only be necessary to treat a straight tube section, such as the section near the tube plate of a heat exchanger. Accordingly, a probe having a relatively rigid electrode may be used. Heat exchanger tubes utilized in nuclear generating plants typically have diameters from 10 mm to 25 mm. Preferably, the electrode 25 of the probe 10 has a diameter from 1 mm to 12.5 mm, more preferably from 2 mm to 10 mm, and most preferably, from 3 mm to 10 mm. A rigid electrode 25 constructed according to standard techniques in the art, such as a solid platinum electrode, lacks sufficient dimensional stability to function in a narrow tube environment. A suitable rigid electrode 25 for use in the invention has a composite structure with an inner layer of structural metal and an outer layer of platinum.

The inner structural metal layer must have high strength and ductility despite the dimensions of the electrode 25. In addition, the metal must not be deleterious to the electroforming process and must be corrosion resistant so as to maintain its structural integrity despite the electroforming solutions which pass through the probe 10. Preferably, the inner metal layer is titanium or niobium. The titanium and platinum forming the electrode 25 are preferably cold worked so as to maintain their strength. Accordingly, the titanium and platinum are each fully hard. The platinum may be clad on the titanium by first preparing the inner titanium layer, and then extruding the platinum onto it.

The inner metal layer preferably is from 100 microns to 2 mm thick, more preferably from 250 microns to 1 mm thick, and most preferably, from 250 microns to 500 microns thick. The outer platinum layer is preferably from 50 microns to 250 microns thick, more preferably from 75 microns to 250 microns thick, and most preferably, from 100 microns to 200 microns thick.

Figure 2:
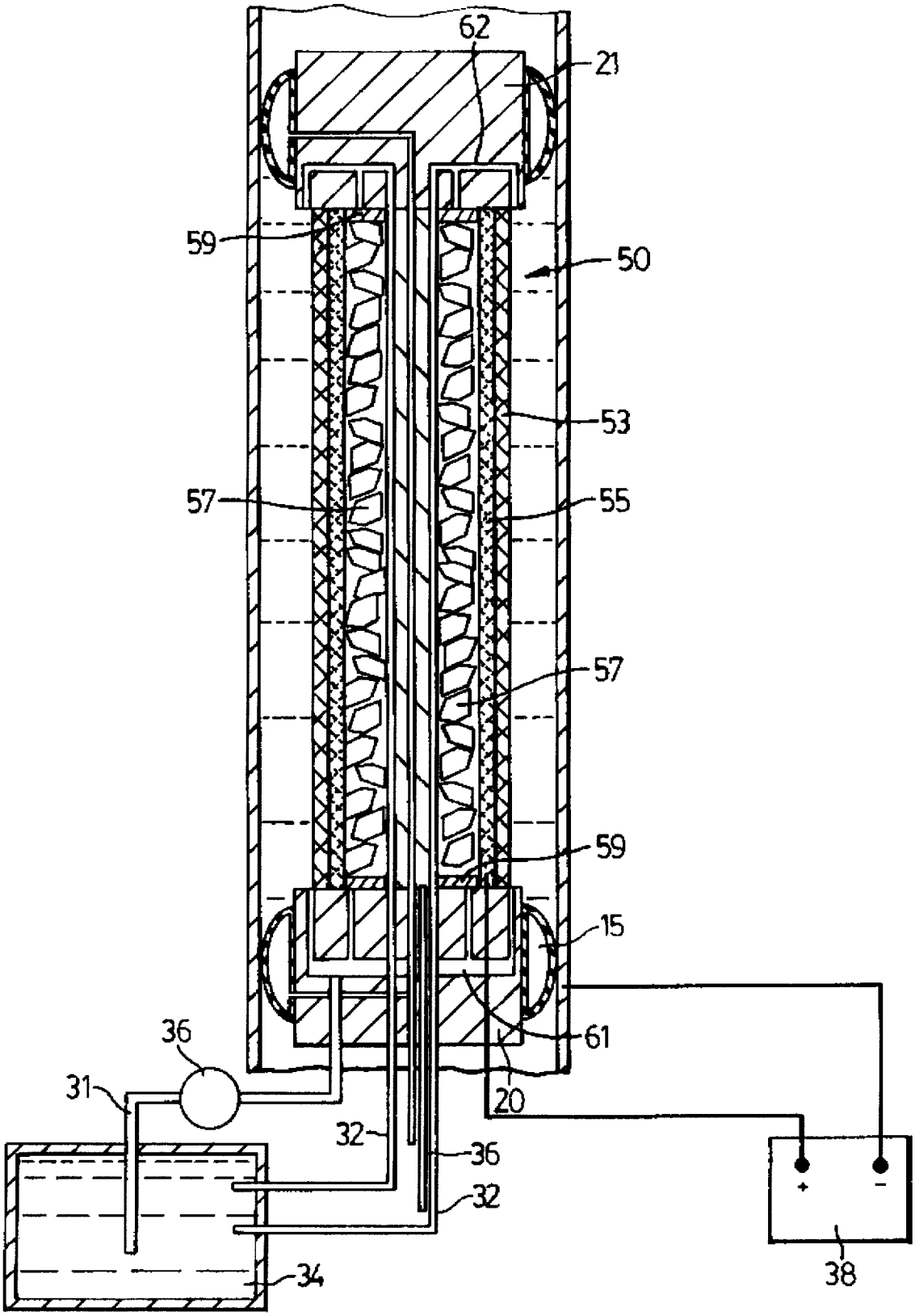
FIG. 2 is a cross sectional view of an alternative probe for performing the process.

An alternative probe 50 is shown in FIG. 2. The structure of the probe 50 is essentially the same as that of the probe 10 (FIG. 1) except that the tubular porous housing 53 and anode 55 are sized and positioned to accommodate the inclusion of pellets of pure metal, e.g. (Ni) 57, within the tubular anode 55. Under electro-forming conditions, the metal pellets 57 oxidize and the metal ions are reduced on the cathode surface, thus driving the reaction toward metal deposition at the cathode (tube wall 14). As some sludge formation normally accompanies the electrochemical ionization of the metal pellets 57, filters 59 are provided at inlets 61 and outlets 62 within the anode 55.

Figure 3:
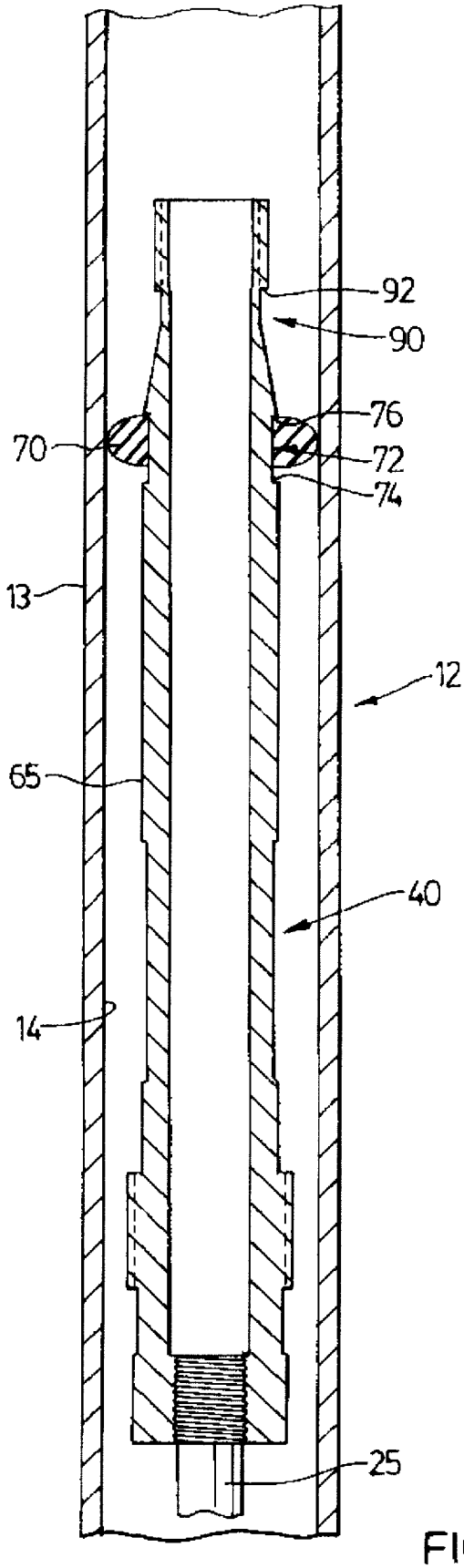
FIG. 3 is cross sectional view of the upper portion of a probe having a thermally expandable O-ring sealing means, wherein the probe is sealed in a tube.

As mentioned, thermally expandable O-ring seals may be used with a probe 40 of the invention as shown in FIGS. 3–6. FIG. 3 shows a tube section 13 which is sealed by a thermally expandable O-ring 70. The O-ring 70 sits in a recess 72 of a probe end 65. The probe end 65 is preferably made of a dimensionally stable, chemically inert, machinable plastic such as that sold by DuPont under the trademark TORLON. The recess 72 has a lower abutting annular face 74 and an upper abutting annular face 76. The O-ring 70 extends from the recess 72 outwardly to the inner wall 14 of the tube section 13, thereby sealing the end of the probe 40. Generally, the O-ring 70 is circular in cross section in its relaxed state. The faces 74 and 76 provide resistance to the travel of the O-ring 70 along the exterior surface of the probe end 65 as the probe 40 is inserted into the tube 12 as well as during the electroforming process. A probe 40 having thermally expandable O-rings 70 has ends 65 and 66 (not shown) at either end of an electrode 25. Preferably the electrode 25 is a rigid composite electrode as described which fastens to the ends 65 and 66 by, for example, threaded connection means. The probe end 66 is essentially the same in structure as the end 65 except that where the end 65 has a trough 90 and abutting annular surface 92 defined beyond the recess 72 toward the end of the probe 40, the end 66 has a trough 90 and abutting surface defined beyond the recess 72 toward the electrode 25 of the probe 40. The reason for this structuring will be apparent from the following description.

Figure 4:
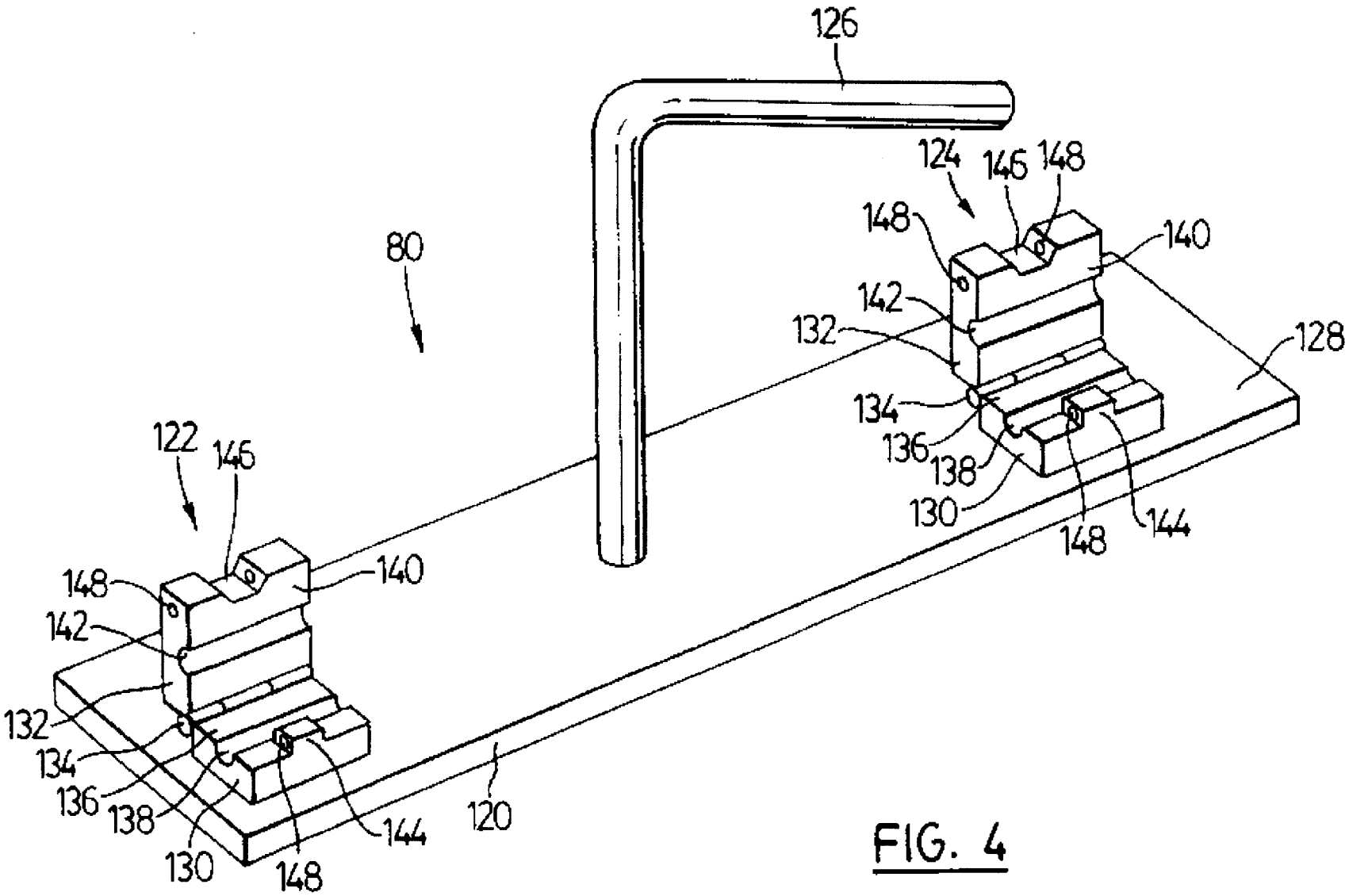
FIG. 4 is a perspective view of a clamp for use in compressing O-ring seals of a probe of FIG. 3.

The method of inserting the O-ring 70 into the tube 12 will now be described with reference to FIGS. 4 and 5. To prepare the probe 40 for insertion, the O-ring 70 is positioned in the recess 72 of the probe end 65. In order to insert the probe 40 into the tube 12, the O-ring 70 must be deformed so that the surface of the O-ring 70 opposite the recess 72 will not contact the tube wall 14 as the probe 40 is inserted therein. A clamp 80, which is shown in FIG. 4, is utilized to compress the O-ring 70 to reduce the outside diameter sufficiently to enable insertion of the probe 40 into the tube section 13.

The clamp 80 comprises a base 120, a first clamping means 122, a second clamping means 124 and a handle 126. The first and second clamping means 122 and 124 are positioned on the upper surface 128 of the base 120 and are located at opposed ends of the base 120. The clamp 120 is adapted for a probe 40 which has an O-ring 70 at either end. Accordingly, the first and second clamping means 122 and 124 are positioned a sufficient distance apart so that each end of the probe 40 which includes an O-ring 70 may be received therein.

Figure 5:
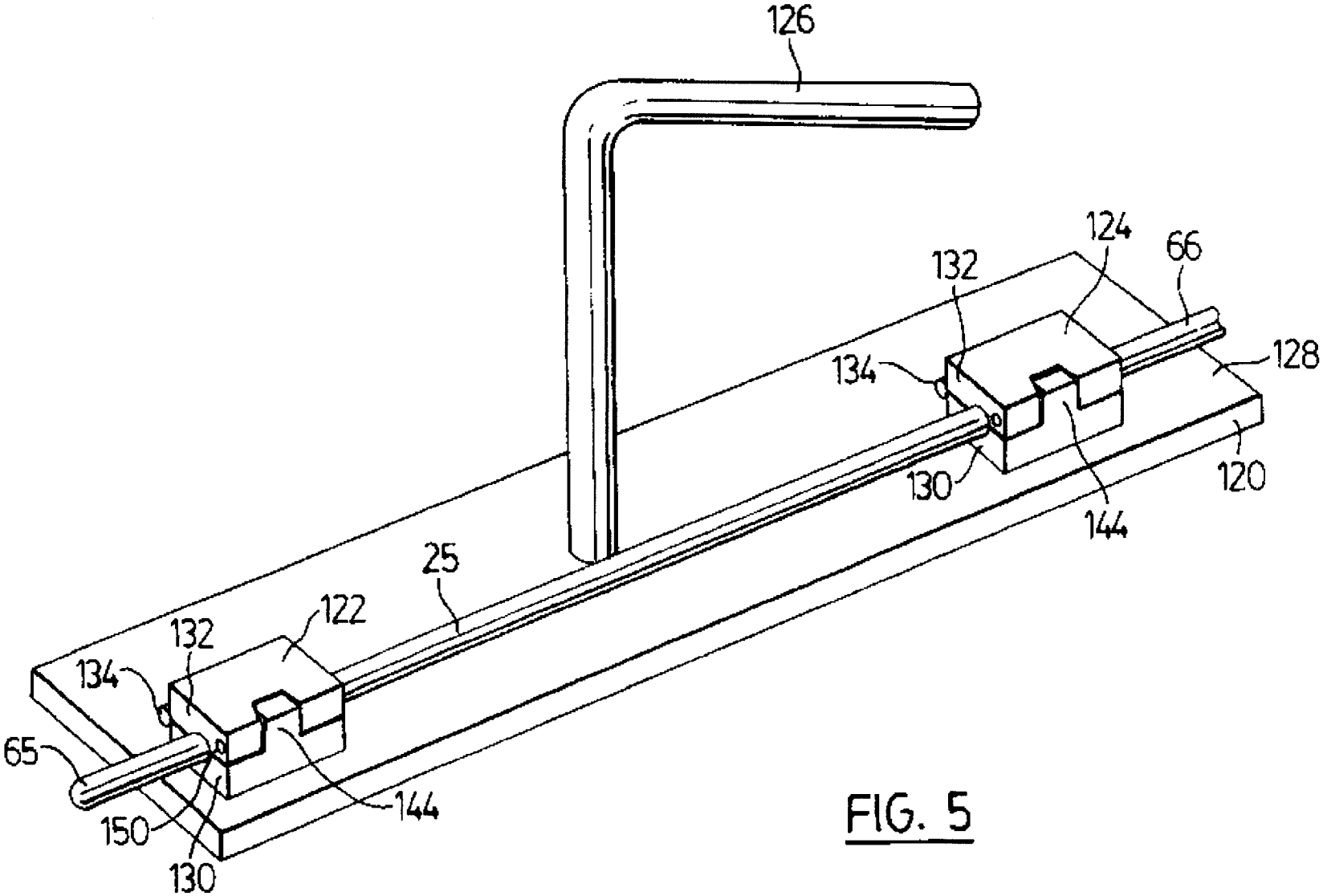
FIG. 5 is a perspective view of a probe with the clamp of FIG. 4 attached thereto.

Each clamping means 122 and 124 comprises a lower portion 130 and an upper portion 132 which are pivotally connected by means of a hinge 134 between an open position (see FIG. 4) and a closed position (see FIG. 5). The lower portion 130 has an upper surface 136 in which a recess 138 is provided. Similarly, the upper portion 132 has an inner surface 140 in which a recess 142 is provided. When the clamping means 122 is closed, the recesses 138 and 142 define a cavity in which the probe end 65 having the O-ring 70 may be received. The circumference of the cavity is sufficiently small so that the O-ring 70 will be deformed (i.e., forced to deform laterally in the axial direction of the probe 40) when the clamping means 122 is closed. The circumference of the cavity is selected so that the probe 40 with the deformed O-rings 70 will be able to be inserted into the tube 12 to be treated.

The inner surface 136 has an upwardly extending flange member 144. The upper portion 132 is provided with a mating recess 146 such that when the clamping means is closed, the flange 144 is received in the recess 146. The upper portion 132 and the flange 144 are provided with laterally extending openings 148 which align when the clamp 80 is closed.

In operation, a probe 40 is placed axially along the base 120 such that the O-ring 70 at each end of the probe 40 is received in the recesses 138. The upper portion 132 of each clamping means 122 and 124 is then closed to the position shown in FIG. 5. The clamping means 122 and 124 may be closed by applying pressure to move the upper portions 132 pivotably downwardly so that the upper surfaces 136 contact the inner surfaces 140o A rod 150 is then inserted through the aligned openings 148 locking the clamping means 122 and 124 in the closed position.

The O-rings 70 are then sufficiently cooled so that they will temporarily remain deformed when the probe 40 is removed from the clamp 80. The degree of cooling which is required will depend upon various factors including the composition of the O-ring 70 as well as the amount of time which will be required to position the probe 40 in the tube section 13. The O-ring 70 is preferably frozen by reducing its temperature to less than −90° C., more preferably to less than −120° C., and most preferably, to −170° C. to −196° C. The O-ring 70 may be frozen by immersing it into liquid nitrogen (−196° C.). The immersion may be achieved by lifting the clamp 80 by the handle 126. If liquid nitrogen is utilized, then the cooling is very rapid and the clamp 80 may only be immersed in the liquid nitrogen for about 5 minutes to attain the desired temperature. The clamp 80 is then removed from the liquid nitrogen, the rods 150 are removed, the clamping means 122 and 124 are opened, and the probe 40 is removed from the clamp 80. The probe 40 is then ready for insertion into a tube 12. Due to the temperature extremes to which the clamp 80 is subjected, it is manufactured from a material, such as carbon steel which may withstand the rapid temperature changes without structural failure.

Once frozen in liquid nitrogen, the O-ring 70 will remain in the deformed state for about 5 minutes while the probe 40 is inserted into the tube section 13. Once the probe 40 is properly positioned, the O-ring 70 will warm and expand to its original shape contacting the tube wall 14 and providing a positive seal for the probe 40. Once in position, the seal may withstand pressures of up to 100 psi without any substantial leaks developing. In comparison, inflatable seals 15 which were described with respect to FIG. 1 may typically withstand pressures of about 20 psi.

Figure 6:
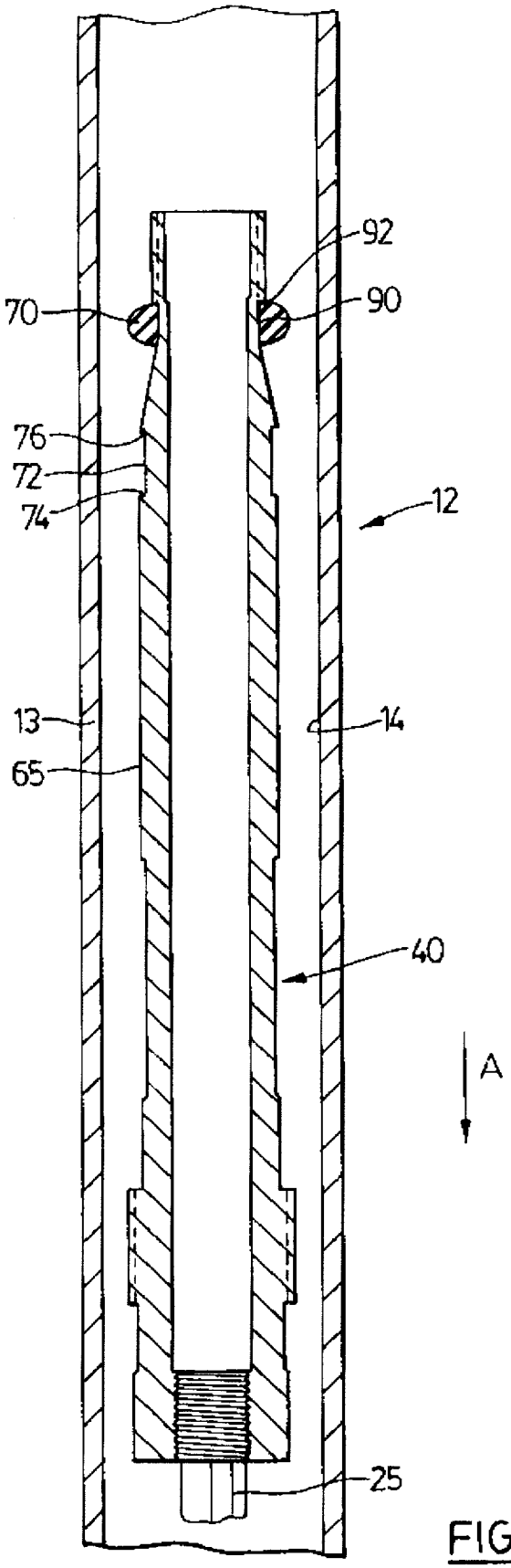
FIG. 6 is a cross sectional view of the probe portion of FIG. 3 wherein the probe is being removed from the tube.

Once the electroforming process is complete, the probe 40 may be removed simply by pulling the probe 40 out of the tube 12. As seen in FIG. 6, by moving the probe 40 in the direction of the arrow A, the O-rings 70 at either end 65 and 66 are caused to roll over the abutting faces 76 and into the troughs 90 where they are retained in position by the abutting faces 92. The troughs 90 are sufficiently recessed so that the outer wall of the O-rings 70, when in the relaxed state, do not contact the tube wall 14 as the probe 40 is moved therein.

The O-ring 70 may be made of any elastomeric material which is capable of being deformed and frozen in the deformed position. The elastomeric material may be a natural or synthetic rubber. In addition, the elastomeric material must be resistant to chemical degradation by the chemicals utilized in the process. Preferably, the O-ring 70 is prepared from a polyfluorocarbon such as that sold under the trademark VITON.

Figure 7:
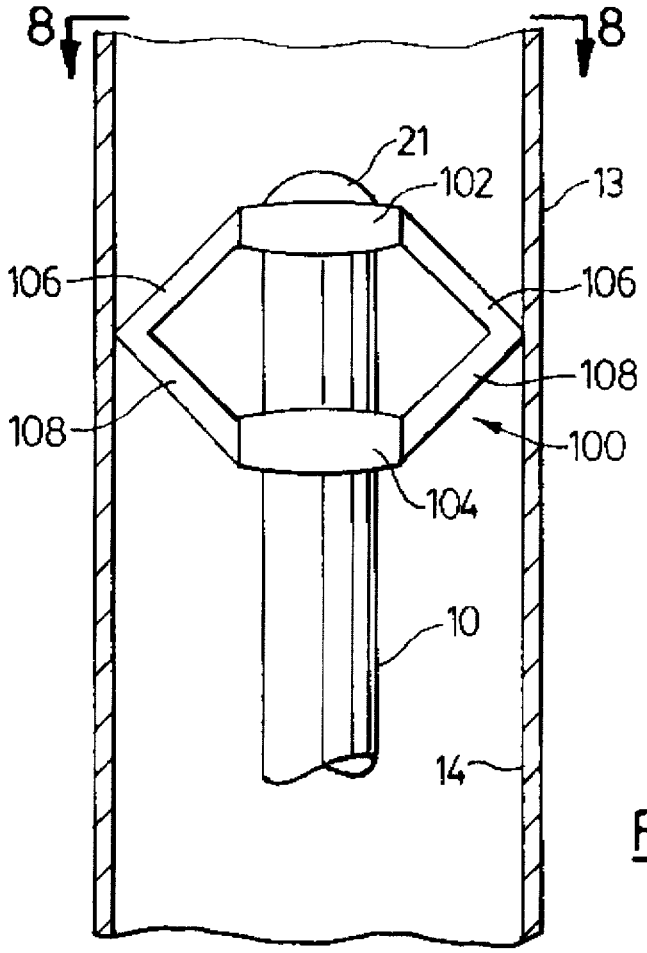
FIG. 7 is a cross sectional view of a probe according to a further embodiment of this invention.
Figure 8:
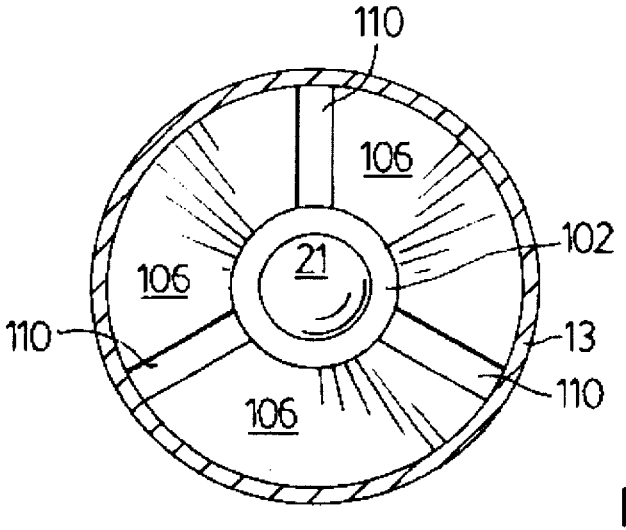
FIG. 8 is a top plan view in the direction of line 8—8 of FIG. 7.

In an alternate embodiment, as shown in FIGS. 7 and 8, one end of the probe 10 may have a seal and the other end may merely be covered by the electrolyte or other process fluid. For example, if the tube 12 is vertically disposed, then the lower end of the probe 10 (e.g., the base 20) may be sealed with an inflatable seal 15 or an O-ring 70. The head 21 may not have a seal. Instead, the tube 12 may be pressurized with air from the end of the tube opposite the end from which the probe 10 is inserted to contain process fluids about the electrode 25 and to ensure that electrode 25 is, at all times, covered with the electrolyte or other process fluids. According to this embodiment, a spacer 100 is provided adjacent the head 21 to position the probe 10 in the centre of the tube section 13 and to maintain the probe 10 at that position during the electroforming process. The spacer 100 has an upper circular portion 102 and a lower circular portion 104. The circular portions 102 and 104 are fixed by any suitable means known in the art to the probe 10. An upper arm 106 extends downwardly from the upper circular portion 102 to the inside wall of tube section 13. A lower arm 108 extends upwardly from the lower circular portion 104 to the inner wall 14 of tube section 13. The arms 106 and 108 meet at the tube wall. As seen in FIG. 8, the arms 106 and 108 extend substantially over the cross section of the tube 12. Openings 110 are positioned between the arms 106 and 108 to permit the electrolyte, or other fluids to flow therethrough. The air pressure in the tube 12 will vary depending upon the rate of fluid flow in the electrochemical cell defined by the probe 10 and the tube wall 14. The air pressure is greater than the fluid pressure in the electrochemical cell.

As discussed above, the conduits 31 and 32 may be quite long, for example up to about 500 ft. Due to the narrow size of these conduits, substantial frictional losses are encountered as the electrolyte flows through the conduit 31 to the probe 10 and is returned to the reservoir via the conduit 32. In order to reduce the entanglement of conduits 31 and 32, the return conduit 32 is typically positioned coaxially within the conduit 31.

Figure 9:
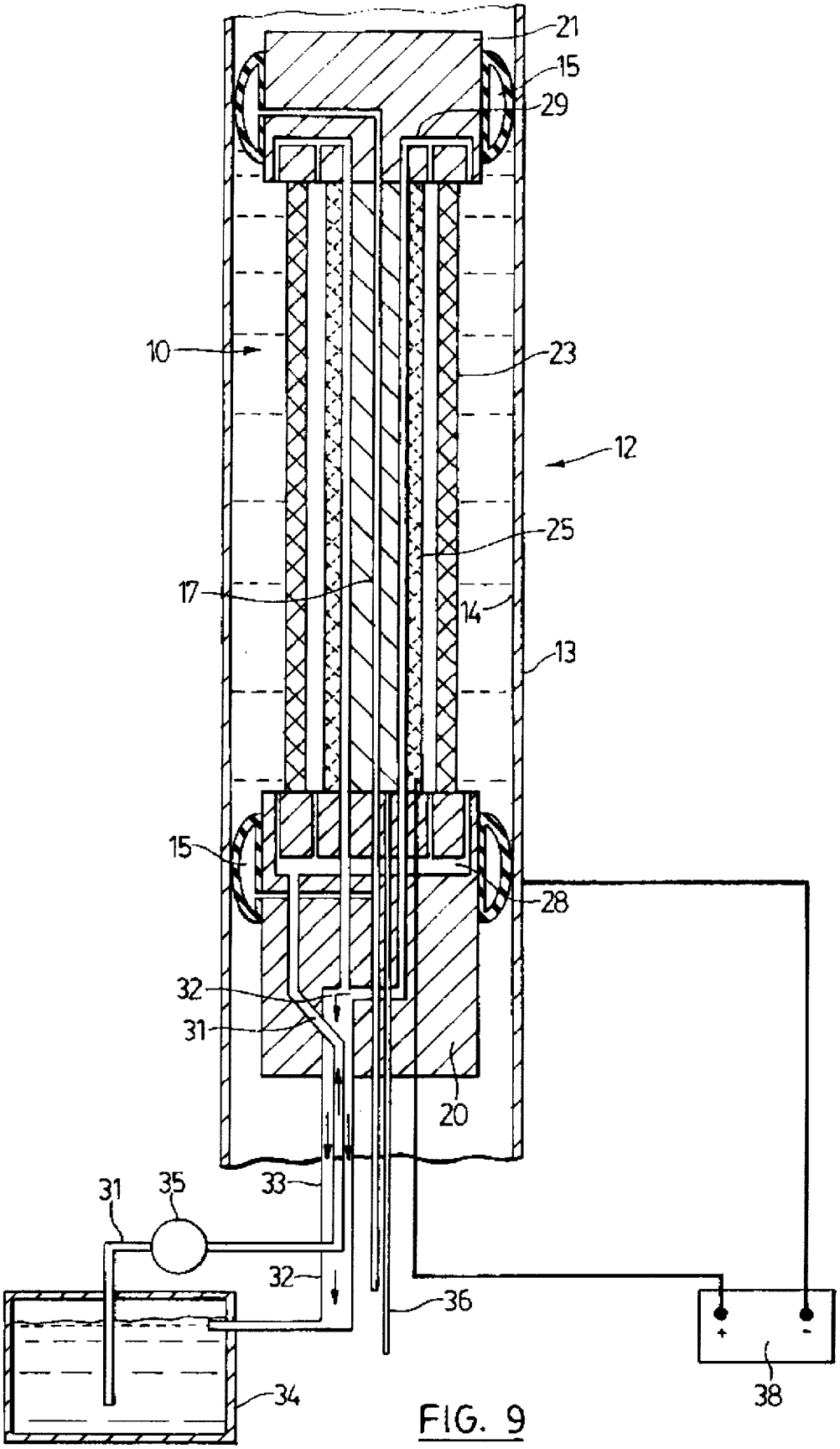
FIG. 9 is a cross sectional view of a further embodiment of a probe according to this invention.

According to the invention, the pressure in the electrochemical cell defined by the probe 10 and the tube section 13 may be substantially reduced by positioning the feed conduit 31 within the return conduit 32 and providing a flow reverser in the base 20 (see FIG. 9).

Referring to FIG. 9, fresh electrolyte is pumped through the conduit 31 into the coaxial conduit 33 which extends from the reservoir 34 to the base 20 of the probe 10. This comprises the majority of the length of the electrolyte conduits. In the base 20, the inner coaxial conduit 31 divides out of the outer coaxial conduit 32. The conduit 31 extends to the feed inlet means 28, and the feed outlet means 29 drains into the conduit 32.

The cross-sectional area of the annular portion of the conduit 32 through which the returned electrolyte flows is larger than the cross-sectional layer of the conduit 31 (through which the fresh electrolyte flows). Accordingly, in the coaxial conduit 33 the fresh electrolyte passing through the inner conduit 31 sustains greater frictional loss than the returned electrolyte flowing through the conduit 32. As a result, the pressure in the fresh electrolyte stream where it enters the electrochemical cell is substantially reduced. The reduced pressure in the electrochemical cell reduces the risk of a leak in the seal 15 at head 21 of the probe. Further, it allows a greater rate of flow of electrolyte through the electrochemical cell, thus permitting increased plating rates.

A preferred process will now be described in relation to the electrodeposition of nickel on the wall 14 of a tube 12. The skilled person will appreciate that various metals or alloys can be electroformed on the tube wall 14 by using the appropriate metals or metal salts under the necessary electrochemical conditions. The chemistry of electroforming is well known. Typically, heat exchanger tubes such as used in power generating facilities are made of a nickel/copper alloy, so the electrodeposition of a nickel layer to repair a degraded tube section 13 of such a heat exchanger tube would in most instances be preferred.

The preferred process of the invention comprises initial surface preparation of the inner wall 14 of the tube section 13, the electrodeposition of a transition film of metal or a strike, and electroforming of the structural metal layer repairing the tube section 13.

The inner surface 14 of the degraded tube section 13 is mechanically cleaned by, for example, brushing or water lancing to remove any loose or semi-adherent deposits. The probe 10 is then inserted into the tube 12 and manipulated to span the degraded section 13. The probe 10 is secured in place in the tube 12 by inflating the seals 15 as described. The secured probe 10 and tube section 13 define an electrochemical cell.

The tube section 13 is degreased by circulating an aqueous solution of 5% NaOH through the probe 10 at a flow rate of 100–400 ml/min., preferably 300–400 ml/min. The flow of fluid through the probe 10 is via the conduits 31 and 32 as described. A current density of 10–100 mA/cm$^2$ is applied between the anode 25 and cathode (tube section 13) for 5–10 min. to vigorously generate hydrogen gas at the inner tube wall surface 14, thereby removing all remaining soils and particulates from the tube surface 14. This degreasing step is followed by a rinsing flow of deionized water through the tube section 13 for about 5 min.

A dilute aqueous solution of strong mineral acid, e.g. 5%–20% HCl, is circulated through the tube section 13 at a flow rate of 100–400 ml/min., preferably 300–400 ml/min., for 5–10 min. to dissolve surface films on the inner wall 14 and to activate the wall surface 14 for electrodeposition.

A transition film of metal or a strike may then be electrodeposited. A strike layer is typically required where the metal on which the electrodeposition is occurring is a passive metal or alloy, such as stainless steel or chromium containing nickel alloys. However, if the metal comprises primarily an active or noble metal or alloy such as iron or copper, then a strike layer may not be required. To deposit a strike layer, a solution of $NiCl_2$ (200–400 g/l) and boric acid (30–45 g/l) as a buffer in water at 60° C. is circulated through the tube section 13 at a rate of 100–400 ml/min., preferably 300–400 ml/min. A current density of 50 mA/cm$^2$ to 300 mA/cm$^2$ is applied across the electrodes for 2–15 min. to allow the deposition of a thin strike of nickel on the inner tube wall 14. A pulsed direct current is preferred for this step and is applied with an average current density of 50—300 mA/cm$^2$, preferably 50–150 mA/cm$^2$, at a frequency of 10–1000 Hz, preferably 100–1000 Hz, with an on-time or duty cycle of 10–60%, preferably 10–40%. Chloride in the electrolyte acts to etch the wall surface 14, thereby assisting the formation of a strong bond between the wall 14 and the strike layer and promoting a continuous metallic interface between the wall 14 and the strike layer. The strike layer should be sufficiently thick to ensure that the portion of the tube wall 14 to be treated does not contain any bare spots. Preferably, the strike layer has a thickness from 2 to 50 μm, more preferably from 5 to 20 μm and, most preferably from 10 to 15 μm.

The tube section 13 preferably is rinsed with deionized water, at 60° C. with a flow rate of 100–1000 ml/min. for 5–20 min. to remove chloride carry over.

A structural layer of fine grained nickel is then electroformed onto the strike by circulating through the tube section 13 an electrolyte comprising an aqueous solution of $NiSO_4$ (300–450 g/l) and boric acid (30–45 g/l), preferably with low concentrations of additives such as sodium lauryl sulfate (surfactant), coumarin (leveler), and saccharin (brightener) each having a concentration not exceeding 1 g/l, preferably 60 mg/l, and applying a pulsed current as described below. Nickel cations are replenished in the electrolyte by the addition of $NiCO_3$. For the repair of heat exchanger tubes, the electrolyte preferably contains a pinning agent such as phosphoric acid as described below.

As the skilled person will appreciate, these additives provide a better quality electroformed layer under most anticipated electroforming conditions. Thus, sodium lauryl sulfate acts to reduce the surface tension of the electrolyte, thereby reducing or eliminating pitting in the surface of the deposited layer. Coumarin acts as a leveler to assist the filling of micro-cracks in the electroforming layer. Saccharin acts to smooth out the surface of the metal layer during electroforming and reduces stresses in the deposit.

The electroforming solution is circulated at a temperature of 25°–90° C. to enhance reaction kinetics, and a pulsed average direct current density of 50–300 mA/cm$^2$ is applied across the electrodes 25 and 13. When electroforming with $NiSO_4$, the average direct current density is preferably 50–150 mA/cm$^2$. The pulsing of the current proceeds at a frequency of 10–1000 Hz, preferably 100–1000 Hz, with the on-time or duty cycle being 10–60%, preferably 10–40%. In many cases, it is advantageous to provide periodic reverses in the polarity of the applied current. The periodic reversal of polarity serves to reverse the electroforming process momentarily. This reversal occurs preferentially at high spots or thicker areas of the deposited layer, thereby tending to encourage the production of a uniform layer thickness. Also, reversing the polarity reactivates the metal surface making it more receptive to further electro-forming. The polarity reversal is carried out periodically at a lower current density than used for electroforming. The amount of polarity reversal optimally does not exceed about 10% of the total duty cycle. Electroforming proceeds for sufficient time to allow the formation of a structural layer of nickel having the desired thickness, typically 0.1–2 mm.

As a final step, the tube section 13 preferably is rinsed with deionized water, preferably at about 60° C., at a flow rate of 100–400 ml/min. for 5–20 min. to remove all residual process chemicals. Upon completion of the process, the seals 15 are deflated and the probe 10 is removed.

According to the process conditions described, a structural layer of nickel may be electroformed onto the inner wall 14 of the tube section 13 in about 1–10 hrs. The process efficiency using the described platinum electrode is typically 70–100%, and may be in the range 90–100%. The efficiency generally varies within this range depending on the metal salts used and the average current density applied (i.e. a higher current density reduces efficiency). Process efficiency can be increased to essentially 100% by using a probe 50 as shown in FIG. 2 and described above.

The electroformed layer produced according to the invention possesses an ultrafine grain microstructure wherein the grain sizes are in the range 20–5000 nm, preferably 20–1000 nm, more preferably 100–250 nm and most preferably the layer has an average grain size of 100–200 nm. Typically, the size of grains in process equipment varies from 20 to about 40 microns. Accordingly, the method of the present invention permits the deposition of crystals which are at least about one order of magnitude smaller than the metal substrate on which they are plated and may in fact be two or three orders of magnitude smaller. Accordingly, the structural layer so deposited forms a generally uniform coating on the metal surface treated to repair the corrosion or other degradation.

The physical properties of a metal and its susceptibility to environmental degradation such as intergranular stress corrosion cracking, intergranular attack, hydrogen embrittlement and corrosion fatigue are related to its grain size, microstructure and chemistry. Thus, small grain size of a metal correlates with greater metal strength and higher ductility (for a review, see Fougere et al., Scripta Metall. et Mater., 26, 1879 (1992)).

The invention enables the production of an electroformed layer which has a fine grained structure with uniform chemical composition. The electroformed sleeve of the invention possesses enhanced strength while maintaining excellent ductility. In addition, the electroformed metal according to the invention has good resistance to corrosion.

The structural layer which is electroformed may have a thickness from 0.1–2 mm. The thickness of the structure will depend upon the desired mechanical properties and corrosion resistance of the sleeve material relative to the initial design standards. For example, if a heat exchanger tube is being repaired, then the structural layer should be sufficiently thin so as not to interfere with the fluid flow through the tube or the heat transfer across it. Generally, the smaller the average grain size of the crystals, the stronger the structural layer. Accordingly, the smaller the grain size, the smaller the required thickness of the structural layer.

Further, the process can provide a high degree of crystal lattice twinning between grains. The invention allows the production of an electroformed layer which has greater than 10% twin boundaries, more preferably greater than 30% twin boundaries, and most preferably 50%–70% twin boundaries. A high degree of twin or "special" grain boundaries (such as twin boundaries) on the order of >30%, correlates with greater resistance to grain boundary cracking mechanisms such as intergranular stress corrosion cracking as compared to metals not having such special grain boundaries (see Palumbo et al., Scripta Metall. et Mater., 25, 1775 (1991)).

Figure 10:
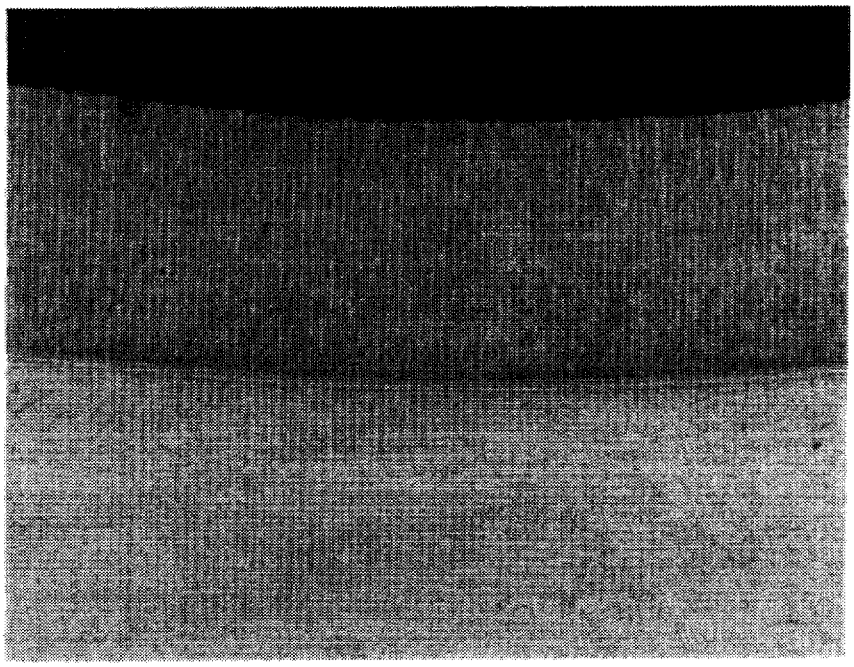
FIG. 10 is a cross sectional optical photomicrograph (100X) showing an electroformed nickel layer produced according to the invention.
Figure 11:
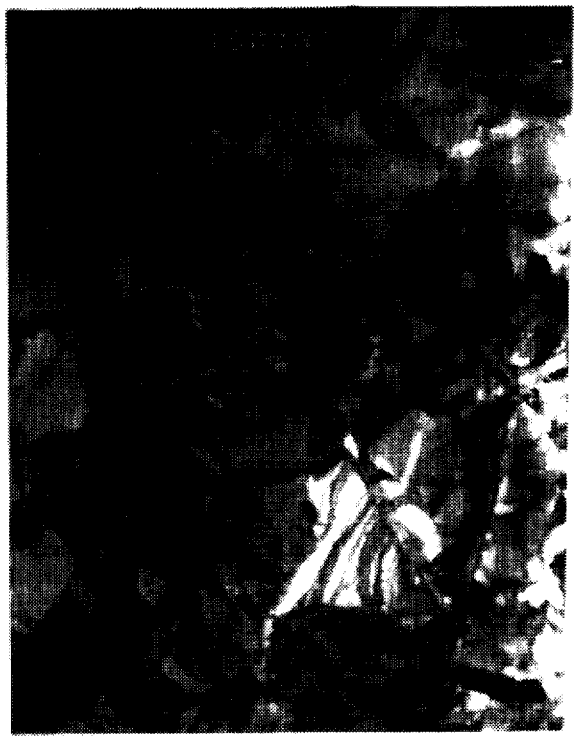
FIG. 11 is a transmission electron micrograph (15000X) showing the ultra-fine grain structure and high degree of twinning for a nickel layer produced according to the invention.

FIG. 10 shows a cross sectional optical photomicrograph (100X) showing an electroformed nickel layer produced in a tube according to the process of the invention. The uniform fine grained structure of the nickel layer is evident in this Figure. The high degree of twinning which is indicative of a high fraction of "special" grain boundaries in the structural nickel layer formed by the process of the invention is apparent from the 15,000X magnification of the micrograph of FIG. 11.

The fine grained, highly twinned microcrystalline structure of a nickel layer formed by the present process provides minimum mechanical properties as follows: Vickers hardness ≧200; yield strength ≧80,000 psi; tensile strength ≧100,000 psi; and elongation to failure in bending ≧10%; preferably Vickers hardness ≧250; yield strength ≧100,000 psi; tensile strength ≧150,000 psi; and elongation to failure in bending ≧10%.

Heat exchanger tubes, such as nuclear steam generator tubes, typically operate at temperatures of about 300° C. At such temperatures, the grains in the electrodeposited metal tend to grow. The increase in the grain size results in decreased strength of the structural layer over time. To maintain the mechanical properties of the electroformed layer, it is preferred to inhibit the growth of the grains in the electroformed layer. In order to reduce, or eliminate, this grain growth problem, the as plated grain size is stabilized by adding a grain boundary pinning agent. Preferably, the pinning (stabilization) agent is phosphorous or molybdenum. Phosphorous may be introduced into the electroformed layer by adding a chemical that releases phosphorous such as phosphoric acid or phosphorous acid or both to the electrolyte. Preferably, the electrolyte contains at least 0.1 g/l of the pinning agent, more preferably from 0.1 to 5 g/l and, most preferably 0.15 g/l of the stabilizing agent. For most applications, an electroformed metal comprising from 400 to 4,000 ppm by weight phosphorous achieves the desired grain size stabilization.

Corrosion resistance agents and strengthening agents may be added to the electrolyte to increase the strength or corrosion resistance or both of the electroformed metal.

Examples of corrosion resistance agents are manganese sulfate, sodium molybdate and chromium salts such as chromium chloride. Examples of strengthening agents include manganese sulfate, sodium tungstate and cobalt sulfate. Up to about 50 g/l of each of these agents may be added to the electrolyte. Such additions result in electroformed metals containing less than 5 wt. % of each constituent metal of these agents.

By using the process of the invention, it is possible to create an electroformed material having two or more layers wherein abutting layers each have a different composition. For example, to reinforce a steam generator tube, a thick layer of nickel may be first electroformed on the area to be treated. Subsequently, a thin layer of the material from which the steam generator tube is manufactured may be electroformed. Electro-forming most of the thickness of the sleeve (e.g., about 90%) from nickel is advantageous due to the high plating rates that are possible. Further, the electrodeposition of nickel requires a relatively minimal amount of monitoring. Electrodepositing an outer layer which has a composition akin to that of the steam generator tube helps to ensure electrochemical compatibility in the operating environment.

We claim:

1. A metal tube having an internal wall to a degraded section of which is electroformed a structural layer of metal having an ultrafine grain microstructure with an average grain size in the range 20–500 nm, wherein the metal of the structural layer has 10%–70% twinned grain boundaries, said layer having a thickness from 0.1 mm to 2.0 mm to restore the degraded section at least to its original mechanical specifications.

2. A metal tube as claimed in claim 1, wherein the metal of the structural layer has 30%–70% twinned grain boundaries.

3. A metal tube as claimed in claim 1, wherein the metal of the structural layer has 50%–70% twinned grain boundaries.

4. A metal tube as claimed in claim 1, wherein the average grain size ranges from 20 to 1000 nm.

5. A metal tube as claimed in claim 1, wherein the average grain size ranges from 100 to 250 nm.

6. A metal tube as claimed in claim 1, wherein the structural layer comprises a sufficient amount of a pinning agent incorporated therein to inhibit the growth in size of the grains in the electroformed structural layer over time subsequent to deposition.

7. A metal tube as claimed in claim 6, wherein the pinning agent is phosphorous or molybdenum.

8. A metal tube as claimed in claim 7, wherein the pinning agent is phosphorus and comprises 400–4000 ppm by weight of the electroformed layer.

9. A metal tube as claimed in claim 6, wherein the structural layer includes a corrosion resistance agent or a strengthening agent, or both.

10. A metal tube as claimed in claim 9, wherein the corrosion resistance agent consists of the group:

manganese sulfate, sodium molybdate and chromium salts;

and the strengthening agent consists of the group:

manganese sulfate, sodium tungstate and cobalt sulfate.

11. A metal tube as claimed in claim 1, wherein said structural layer comprises a plurality of layers each of a different chemical composition.

12. A metal tube as claimed in claim 1, wherein the tube is an alloy of any of iron, copper or nickel, and the electroformed structural layer is nickel having a Vickers hardness≧200, a yield strength≧80,000 psi, a tensile strength≧100,000 psi, and an elongation to failure in bending≧10%.

13. A metal tube as claimed in claim 12, wherein the structural layer has a Vickers hardness≧250, a yield strength≧100,000 psi, a tensile strength≧150,000 psi, and an elongation to failure in bending≧10%.

* * * * *